United States Patent [19]

Hellwig et al.

[11] Patent Number: 4,892,201

[45] Date of Patent: Jan. 9, 1990

[54] JIB SYSTEM FOR CRANES, ESPECIALLY MOBILE CRANES

[75] Inventors: Harry Hellwig; Klaus-Dietrich Sturm, both of Leipzig, German Democratic Rep.

[73] Assignee: VEB Schwermaschinenbaukombinat Takraf, Leipzig, German Democratic Rep.

[21] Appl. No.: 192,812

[22] Filed: May 11, 1988

[30] Foreign Application Priority Data

Jul. 8, 1987 [DD] German Democratic Rep. ... 304749

[51] Int. Cl.[4] ..... B66C 23/26

[52] U.S. Cl. ..... 212/186; 212/182; 212/200; 212/261; 212/262

[58] Field of Search ..... 212/182, 183, 184, 185, 212/186, 238, 260, 261, 262, 263, 200, 199

[56] References Cited

U.S. PATENT DOCUMENTS

| | | | |
|---|---|---|---|
| 1,595,029 | 8/1926 | Smith et al. | 212/200 |
| 2,570,417 | 10/1951 | Wulleman | 212/262 |
| 3,011,652 | 12/1961 | Falk et al. | 212/203 |
| 3,365,077 | 1/1968 | Mork | 212/199 |
| 3,777,900 | 12/1973 | Brewer | 212/200 |
| 3,967,744 | 7/1976 | Goyarts | 212/261 |
| 4,544,071 | 10/1985 | Poock | 212/262 |

FOREIGN PATENT DOCUMENTS

| | | | |
|---|---|---|---|
| 1925631 | 11/1969 | Fed. Rep. of Germany | 212/185 |
| 2201683 | 5/1973 | Fed. Rep. of Germany | 212/261 |
| 145850 | 1/1981 | German Democratic Rep. | . |
| 124086 | 5/1959 | U.S.S.R. | 212/186 |
| 2167379 | 5/1986 | United Kingdom | . |
| 2184092 | 6/1987 | United Kingdom | 212/238 |

*Primary Examiner*—Joseph F. Peters, Jr.
*Assistant Examiner*—Thomas J. Brahan
*Attorney, Agent, or Firm*—Jordan and Hamburg

[57] ABSTRACT

A telescopic outrigger is swivel mounted and disposed so that it can be moved in the longitudinal direction in an jib trough. When the telescopic jib is in its horizontal or slightly inclined operating position, it is situated in the jib trough. In order to achieve a steep operating position, it is moved lengthwise in the jib trough in the direction of the jib tip, and is raised up about a pivot.

6 Claims, 3 Drawing Sheets

JIB SYSTEM FOR CRANES, ESPECIALLY MOBILE CRANES

The invention relates to a jib system for cranes, especially mobile cranes. The jib system can be used for auto and railroad cranes with jibs, which can be telescoped repeatedly.

BACKGROUND OF THE INVENTION

Various arrangements of the derrick cylinders are known for cranes with telescopic jibs. Auto cranes with telescopic jibs predominantly have a luffing cylinder arrangement located near the pivot of the jib. These cranes achieve maximum luffing angles and thus large lifting heights and lifting loads. With this arrangement of the luffing cylinder, the jibs are primarily stressed by compressive forces. In the horizontal operating position, the jib can be loaded only to a limited extent with this arrangement of the derrick cylinder.

With railroad cranes, the luffing cylinders are disposed in the front part of the crane superstructure, usually at a larger distance from the jib pivot. Thus, the maximum carrying capacity is reached when the jib is in its horizontal operating position. The attainable lifting height is limited by the excursion length of the working cylinders and by their arrangement.

DD Patent 145,850 discloses a solution with a telescopic jib in a swivel mounted guide piece. The guide piece is mounted in the front part of the crane superstructure and can be adjusted by means of a cable pulley.

The disadvantage of this solution is that the jib can be telescoped only in its horizontal operating position. In other operating positions, the jib is locked and the telescope cannot be used. Another disadvantage is that the large forces from the horizontal operating mode of the crane are unfavorably conducted through the luffing gear into the crane superstructure.

Another solution is disclosed in DD Patent No. 229,101. The lower section of a bendable jib is swivel mounted on the crane superstructure. The upper part of the jib is telescoped repeatedly and luffed about the bending point by the working cylinder.

The disadvantage of this solution is the great effort involved in setting up and in the special mounting of the derrick cylinders, which must detach from the upper section of the jib during the erection process. Furthermore, the expensive equipment for swinging the telescopic jib open and closed is another disadvantage, since the jib can be swung open only in the retracted state.

A less complicated jib system must be created which can be used in tightly constricted working spaces and with great lifting heights, which requires little erection effort, and which achieves high carrying capacity.

SUMMARY OF THE INVENTION

It is an object of the invention to provide an jib system which can be used both in a horizontal working position and in a steep working position and which can be telescoped in both operating modes, it being possible to achieve a favorable force application.

Pursuant to the invention, this objective is achieved by disposing a multi-section telescopic jib, which in itself is well-known, in a jib trough so that it can be moved and pivoted. The top of the jib trough is open and the trough is mounted on an upper section of the crane so that it can luff about a pivot. By means of drive equipment, which is not described in more detail, the multi-section telescopic jib can be moved horizontally or in its luffed working position, and it can be run out through a telescoping mechanism that is in itself well known. In this working position of the multi-section telescopic jib, the lifting tool is used as a telescopic crane with a bending outrigger.

The pivot and the anchoring bracket of the telescopic jib are movably and fixably disposed between the end points in the jib trough. A retracting support and a cable pulley system are raised up to a predetermined height through tension elements that are tensioned by the telescoping mechanism. With the help of the cable pulley system and a drive unit, the jib is pulled from its horizontal position into the working position of a telescopic pressure jib. In the state of rest, the retracting support and the cable pulley system are stored between the crane superstructure and the multi-part telescopic jib.

BRIEF FIGURE DESCRIPTION

The invention will now be explained in more detail by way of an embodiment, and in particular FIG. 1 shows a representation of a multi-part telescopic jib in its horizontal working position;

DETAILED DISCLOSURE OF THE INVENTION

Figure 1:
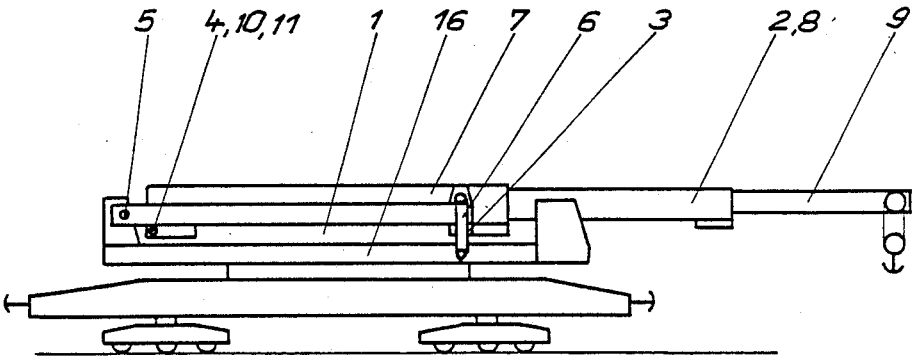

According to FIG. 1, a jib 2, which can be telescoped repeatedly, is guided in a jib trough 1 by pressure rollers 3 and thrust bearings 4. The jib trough 1 is swivel mounted about the pivot 5 and adapted to be moved by the working cylinders 6. The telescopic jib 2 consists of the guiding telescopic section 7, the middle telescopic section 8, and the tip telescopic section 9, and it is movably mounted in the jib trough 1. The jib reaches a certain length through the excursion of the middle telescopic section 8 and of the tip telescopic section 9. To increase this length, as seen in FIG. 3, the jib forwarding mechanism 10 causes the guide telescopic section 7 with the further telescopic sections 8, 9 in the jib trough 1 to move in the direction of the load hook, up to the possible end point 11.

Figure 2:
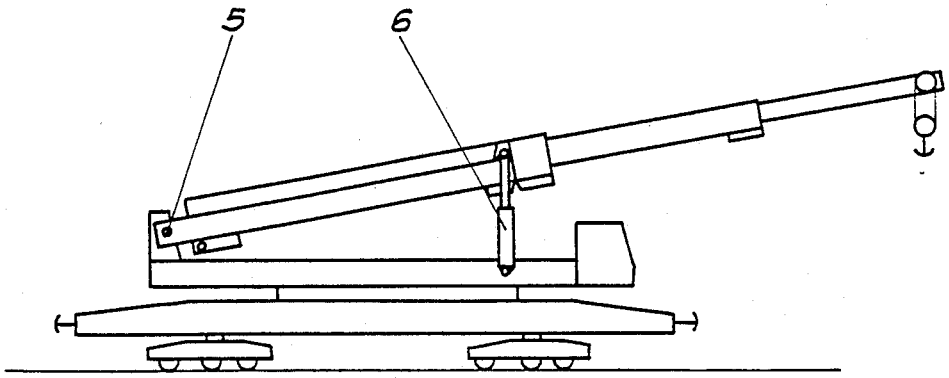
FIG. 2 shows a representation of a multi-part telescopic jib in its luffed working position.

To achieve greater lifting heights, the telescopic jib 2 is tilted as shown in FIG. 2. The jib trough 1 with the telescopic sections 7 and 9 is swiveled about the pivot 5 by means of the working cylinders 6.

Figure 3:
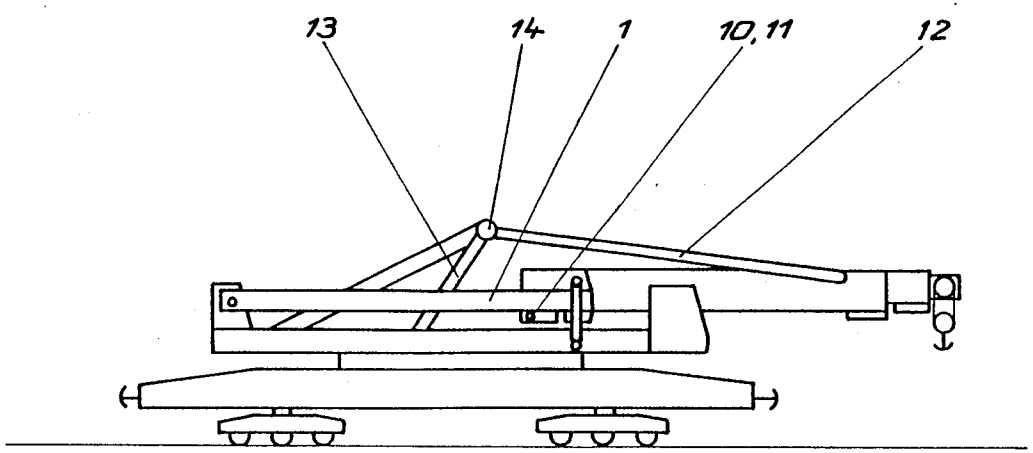
FIG. 3 shows the tensioning and raising process of the retracting support and of the cable pulley system.

To achieve the operating modification with the steep working position, the telescopic jib 2, according to FIG. 3, is first moved by the jib forwarding mechanism 10 up to the end point 11.

Figure 4:
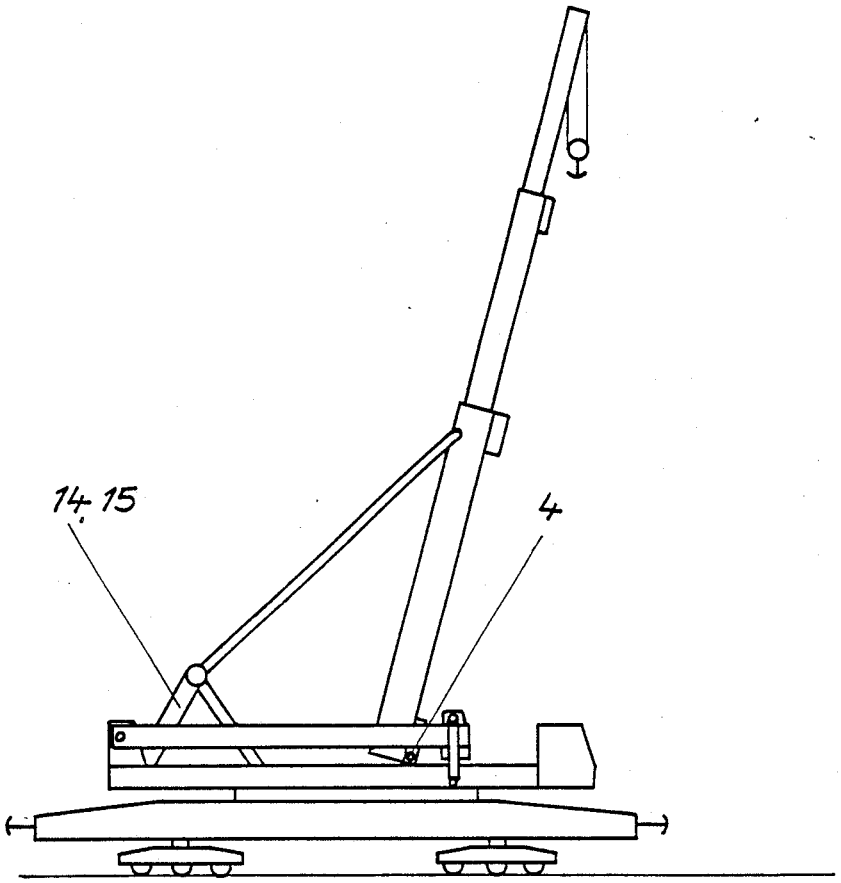
FIG. 4 shows a representation of a multi-part telescopic jib in its steeply inclined working position.

Then, the tension element 12, which can be a pull rod that can be telescoped or folded, is tensioned. It lifts the retracting support 13 automatically to a prescribed height. The cable pulley 14 is tightened by means of the retracting support 13. In the state of rest, the retracting support 13 and the cable pulley 14 are stored on the crane superstructure below the jib 2. The pressure bearing 4 is positioned as shown in FIG. 4 and is raised up through the outrigger lifting mechanism 15 of the telescopic jib.

The advantages of the jib system are the large carrying forces that are attained both in the horizontal and in the steep operating positions, while the equipment costs are relatively low.

We claim:

1. In a jib system for a crane mounted to swivel about a pivot on an upper section of the crane, the jib system including a telescopic jib mounted to be shifted by a jib forwarding mechanism, the improvement wherein the pivot of the telescopic jib is movably mounted in a jib trough, the jib trough is mounted to be luffed by a working cylinder, and further comprising retracting means for retracting said telescopic jib, said retracting means comprising a cable pulley, retracting support means for holding said cable pulley on said crane, a pulling element connecting said cable pulley to said telescopic jib, and lifting means for raising and lowering said support means, whereby said jib is pivoted about said pivot.

2. The jib system of claim 1, wherein the pivot of the telescopic jib is mounted to be shifted in the jib trough and positioned between the ends of said trough.

3. The jib system of claim 1, wherein the jib trough is mounted to be rotated about an axle and luffed by the working cylinder.

4. The jib system of claim 1, wherein, in the stationary state, the cable pulley and the retracting support are stored on a superstructure of the crane below the jib.

5. The jib system of claim 1, wherein the cable pulley is mounted so that it can be raised up automatically by said lifting means.

6. The jib system of claim 1, wherein the pulling element comprises a pull rod.

* * * * *